US012486633B2

(12) United States Patent
Zepmeisel et al.

(10) Patent No.: US 12,486,633 B2
(45) Date of Patent: Dec. 2, 2025

(54) CIVIL ENGINEERING MACHINE

(71) Applicants: RTG Rammtechnik GmbH, Schrobenhausen (DE); TECHNE KIROW GmbH, Leipzig (DE)

(72) Inventors: Stefan Zepmeisel, Baar-Ebenhausen (DE); Bernhard Lindermair, Kühbach (DE); Walter Koellner, Netteta (DE); Ludwig Koehne, Berlin (DE)

(73) Assignees: RTG Rammtechnik GmbH, Schrobenhausen (DE); TECHNE KIROW GmbH, Leipzig (DE)

( * ) Notice: Subject to any disclaimer, the term of this patent is extended or adjusted under 35 U.S.C. 154(b) by 179 days.

(21) Appl. No.: 18/557,481

(22) PCT Filed: Apr. 5, 2022

(86) PCT No.: PCT/EP2022/058916
§ 371 (c)(1),
(2) Date: Oct. 26, 2023

(87) PCT Pub. No.: WO2022/228833
PCT Pub. Date: Nov. 3, 2022

(65) Prior Publication Data

US 2024/0209588 A1 Jun. 27, 2024

(30) Foreign Application Priority Data

Apr. 29, 2021 (EP) ..... 21171346

(51) Int. Cl.
*E02D 7/16* (2006.01)
*E02D 7/18* (2006.01)
(Continued)

(52) U.S. Cl.
CPC ..... *E02D 7/165* (2013.01); *E02D 7/18* (2013.01); *E02D 7/20* (2013.01); *E21B 7/023* (2013.01)

(58) Field of Classification Search
CPC .. E02D 7/165; E02D 7/18; E02D 7/20; E02D 7/023; E21B 7/023
See application file for complete search history.

(56) References Cited

U.S. PATENT DOCUMENTS 7,640,998 B2 * 1/2010 Howell, Jr. ..... E21B 7/027 173/28
11,346,070 B2 * 5/2022 Shevtsov ..... E02D 7/08
2020/0283981 A1 * 9/2020 Shevtsov ..... E02D 7/08

FOREIGN PATENT DOCUMENTS

CN 108505518 A 9/2018
CN 108708674 A * 10/2018 ..... E21B 7/021
(Continued)

OTHER PUBLICATIONS

International Preliminary Report on Patentability (Chapter I) and Written Opinion of the International Searching Authority issued in PCT/EP2022/058916; issued Oct. 24, 2023.
(Continued)

*Primary Examiner* — Frederick L Lagman
(74) *Attorney, Agent, or Firm* — Studebaker Brackett PLLC

(57) ABSTRACT

The invention relates to a civil engineering machine with a undercarriage comprising a track chassis, a superstructure mounted on the undercarriage, so as to be rotatable about a vertical axis of rotation, a leader with a linear guide along which a work carriage with a construction work implement is displaceably mounted, and an articulation mechanism by means of which the leader is adjustably mounted on the superstructure. According to the invention it is provided that the articulation mechanism comprises a telescopic arm by
(Continued)

means of which a distance of the leader relative to the superstructure can be adjusted.

11 Claims, 6 Drawing Sheets

(51) Int. Cl.
*E02D 7/20* (2006.01)
*E21B 7/02* (2006.01)

(56) References Cited

FOREIGN PATENT DOCUMENTS

| | | | | | |
|---|---|---|---|---|---|
| CN | 111350182 | A | * | 6/2020 | ..... B25D 9/00 |
| CN | 211898371 | U | | 11/2020 | |
| CN | 114658353 | A | * | 6/2022 | ..... E21B 44/00 |
| EP | 0 392 309 | A2 | | 10/1990 | |
| EP | 0392310 | A2 | | 10/1990 | |
| EP | 0 392 310 | B1 | | 12/1993 | |
| EP | 1077306 | A2 | | 2/2001 | |
| EP | 1 077 306 | B1 | | 10/2006 | |
| EP | 2336481 | A1 | | 6/2011 | |
| EP | 3 228 382 | A1 | | 10/2017 | |
| ES | 2343032 | T3 | * | 7/2010 | ..... E21B 7/023 |
| GB | 1133072 | A | | 11/1968 | |
| JP | S51-003205 | U | | 1/1976 | |
| JP | 2014-025200 | A | | 2/2014 | |

OTHER PUBLICATIONS

An Office Action mailed by the Korean Intellectual Property Office on Apr. 4, 2025, which corresponds to Korean Patent Application No. 10-2023-7039155 and is related to U.S. Appl. No. 18/557,481; with English language translation.

Communication pursuant to Article 94(3) EPC issued by the European Patent Office on Nov. 30, 2023, which corresponds to European Patent Application No. 21171346.6-1005 and is related to U.S. Appl. No. 18/557,481.

An Office Action mailed by the Eurasian Patent Office on Sep. 24, 2024, which corresponds to Eurasian Patent Application No. 202392489 and is related to U.S. Appl. No. 18/557,481.

An Office Action; "Notice of Reasons for Refusal," mailed by the Japanese Patent Office on Jun. 4, 2024, which corresponds to Japanese Patent Application No. 2023-567069 and is related to U.S. Appl. No. 18/557,481.

International Search Report issued in PCT/EP2022/058916; mailed Jun. 2, 2022.

* cited by examiner

CIVIL ENGINEERING MACHINE

TECHNICAL FIELD

The invention relates to a civil engineering machine with a undercarriage comprising a running gear, a superstructure mounted on the undercarriage so as to be rotatable about a vertical axis of rotation, a leader with a linear guide along which a working carriage with a construction work implement is displaceably mounted, and an articulation mechanism by means of which the leader is adjustably mounted on the superstructure.

BACKGROUND

Civil engineering machines with leaders are well known and are used, for example, to create bored piles in the ground, earth anchors, or to insert sheet piles into a ground by vibrating or impacting. The civil engineering machines are used, in particular for carrying out foundation procedures for constructions or along constructions.

A leader constitutes an essentially vertical mast, which is formed with a longitudinal guide at its front side. A working carriage with a construction work implement is displaceably mounted along the longitudinal guide. Such a civil engineering machine with a leader, wherein a vibrator is provided as the construction work implement, is for example disclosed in EP 3 228 382 B1.

The leader is connected to a mobile carrier device via an articulation mechanism. In EP 3 228 382 B1, the articulation mechanism has pivoted levers in a so-called parallelogram arrangement, wherein a distance between the leader and the carrier device can be adjusted by pivoting the pivoted levers. Due to the mechanism, a change in the distance between the leader and the carrier device always results in a certain change in position in the vertical direction. This can be compensated by means of a holding device by means of which the vertical leader is connected to the parallelogram arrangement of the pivoted levers in a vertically adjustable manner.

In certain cases, it is necessary to carry out such foundation procedures near or along railroad tracks. For this purpose, the generic EP 0 392 310 B1 for example discloses that a undercarriage of a conventional civil engineering machine can be equipped with wheels that enable it to travel on rails. This means that the civil engineering machine equipped and retrofitted in this way can travel on the tracks, in order to carry out appropriate civil engineering procedures from a working position on the tracks.

As a rule, only relatively short distances can be covered on tracks with such retrofitted civil engineering machines. In addition, due to the relatively small track width on tracks, there is reduced tipping safety compared to a normal wheel or crawler chassis.

CN 108 505 518 A proposes a horizontally fixed adjusting cylinder for mounting the leader, which supports the leader. Compensation of the vertical alignment of the leader takes place by means of a second telescopic adjusting cylinder. GB 1 133 072 A also proposes a similar attachment for the leader, wherein the horizontally fixed actuating cylinder is actuated mechanically.

EP 1 077 306 A1 discloses the known parallelogram arrangement for supporting the leader with telescopic upper adjusting cylinder and a lower pivoting support arm of fixed length. JP 2014 025200 A suggests an attachment of the leader that is substantially comparable thereto.

CN 211 898 371 U suggests attachment to a boom that can slide horizontally in sliding blocks and can be attached to a corresponding machine.

It is also known to arrange an existing civil engineering machine with a wheeled or crawler chassis, as a whole on a railroad transport car. With such a conventional railroad car, a longer distance can in principle be covered on tracks at a higher speed. However, with such arrangements in conventional civil engineering machines, often the problem arises that only relatively small civil engineering machines can be used so as not to exceed a maximum height specified by overhead contact lines or rail tunnels. In addition, the arrangement of a conventional civil engineering machine on a railroad transport car increases the machine's center of gravity above the ground, which also reduces tipping safety. This then results in a corresponding restriction of the working area and the possible applications of the civil engineering machine.

SUMMARY

The object underlying the invention is to specify a civil engineering machine comprising a leader, by means of which construction work can be carried out in a particularly efficient manner.

The civil engineering machine according to the invention is characterized in that the articulation mechanism comprises a telescopic arm by means of which a distance of the leader relative to the superstructure can be adjusted.

A basic idea of the invention is to use an articulation mechanism with a telescopic arm in a civil engineering machine with a leader, wherein the telescopic arm is oriented substantially horizontally. Thus, by extending or retracting telescoping of the telescopic arm, a distance between the leader and the superstructure, and thus the carrier, can be varied. By using a telescopic arm of variable length, a parallelogram arrangement with pivoting levers can be replaced, in particular.

In addition, a telescopic arm that is variable in length allows a distance of the leader to be changed without significant changes to the vertical position of the leader. Furthermore, the articulation mechanism can be configured to be simple and compact. This also results in a particularly compact design of the civil engineering machine as a whole, in particular with a relatively low overall height of the superstructure and articulation mechanism.

According to the invention, the leader can be adjusted particularly well if the telescopic arm is pivotably mounted on the superstructure about a horizontal pivot axis. In particular, the telescopic arm can be pivotably articulated in an upper region of the superstructure. The telescopic arm or the articulation mechanism is connected to the leader in a lower region, so that the leader can be folded forward. A pivot cylinder, in particular a hydraulic cylinder, can be provided for pivoting the telescopic arm.

Another advantageous embodiment variant of the civil engineering machine according to the invention is that the leader is held on the telescopic arm by a holding device and that the leader is mounted on the holding device so as to be displaceable parallel to its linear guide. The holding device can, in particular have a support beam which is pivotably mounted on the telescopic arm. The leader is preferably mounted so that it can be displaced along the support beam of the holding device parallel to its linear guide. This makes it easy to change the vertical position of the leader and the relative position to the telescopic arm.

For a further improvement of the adjustment possibilities of the leader, it is preferred according to one embodiment of the invention that the holding device has a pivoting unit by means of which the leader can be pivoted about a leader pivot axis which is oriented in parallel to the linear guide of the leader. Thus, the leader can be adjusted and set about a vertical axis which is oriented in parallel to the linear guide.

A further advantageous embodiment of the invention is that a detachable connecting unit is arranged on the holding device, by means of which the leader can be connected to the telescopic arm in an easily detachable manner. Thus, the leader can be mechanically detached from the telescopic arm and removed therefrom, if required.

It is particularly advantageous that the detachable connecting unit can be actuated automatically. Preferably, the connecting unit can have hydraulically actuatable retaining pins that can be adjusted between a locking position and an unlocking position. In this way, a slight mechanical decoupling between leader and telescopic arm can take place, for example when the leader is folded down to an approximately horizontal transport position. Existing line connections, in particular for power and/or data lines, can also be disconnected or preferably remain in place between the leader and the telescopic arm. For this purpose, the connecting lines can be configured with corresponding additional lengths.

According to a further development of the invention, it is particularly advantageous that the leader can be pivoted from a substantially vertical operating position into a substantially horizontal rest position, which is located in front of the superstructure in the longitudinal direction. Thus, it is possible to easily fold down the leader into a horizontal resting or transport position.

It is particularly expedient in this case that the leader is placed on a support in the rest position and that the leader can be detached from the telescopic arm in the placed rest position on the support by detaching the connecting unit from the telescopic arm. The disconnecting can take place partial or complete.

According to the invention, the undercarriage is configured as a track-bounded undercarriage with a running gear having wheels for driving on railroad tracks. By combining an articulation mechanism with a telescopic arm, it is possible to create a track-bounded civil engineering machine that has a particularly compact overall height when the leader is folded down. This is particularly advantageous for travelling along railroad tracks, which are subject to strict height limits with regard to tunnels and existing overhead lines.

It is particularly advantageous in this case that the support is configured for placing the leader on(to) a transport car. In particular, this transport car can itself be a track-bounded transport car having wheels for driving on railroad tracks. The transport car can be coupled to the undercarriage of the civil engineering machine as an auxiliary car. The leader can be placed on the transport car, wherein a connection between the leader and the telescopic arm is completely or partially disconnected, wherein a connection is formed exclusively by connecting lines.

According to a further development of the invention, it is preferred that the telescopic arm can be actuated hydraulically. Preferably, a hydraulic cylinder can be arranged within the telescopic arm in this case. Preferably, the telescopic arm can have an angular, preferably rectangular cross-section, so that the telescopic arm can provide for secure linear guidance of the leader during telescoping in and out. The telescopic arm can be adjusted about the horizontal pivot axis via at least one pivot cylinder and can thus be inclined relative to the horizontal.

According to a further embodiment variant of the invention, it is particularly expedient for the connecting unit to be mounted so that it is pivotable relative to the telescopic arm. For pivoting, a further actuating cylinder can also be provided on the connecting unit. By pivoting the connecting unit relative to the telescopic arm, it can be ensured that the leader still is vertically oriented when the telescopic arm is set at an angle.

In general, any implement can be attached to the civil engineering machine as a construction work implement. According to one embodiment variant of the invention, it is particularly advantageous that the construction work implement on the carriage comprises a vibrator, a drill drive, a pile driver, a sheet pile press or a cutter on the working carriage. In particular, the pile driver may comprise an impact or hammer unit.

A drilling device can be created with a drill drive with which, in particular, bored piles or foundation piles are created in the ground, wherein a created borehole is filled with a preferably curable mass, in particular concrete. The drilling device can also be used to insert drilled or screwed anchors for foundation procedures.

By means of a cutter, vertical trenches can be created in the ground, which, after being filled up with a curable mass, form trench wall segments or contiguous trench walls in the ground. By means of a vibrator, a pile driver, a hammer or a sheet pile press, pile-shaped or plank-like foundation elements can be driven into the ground.

BRIEF DESCRIPTION OF THE DRAWINGS

The invention is further described below with reference to preferred exemplary embodiments, which are shown schematically in the drawings. The drawings show in.

DETAILED DESCRIPTION

Figure 1:
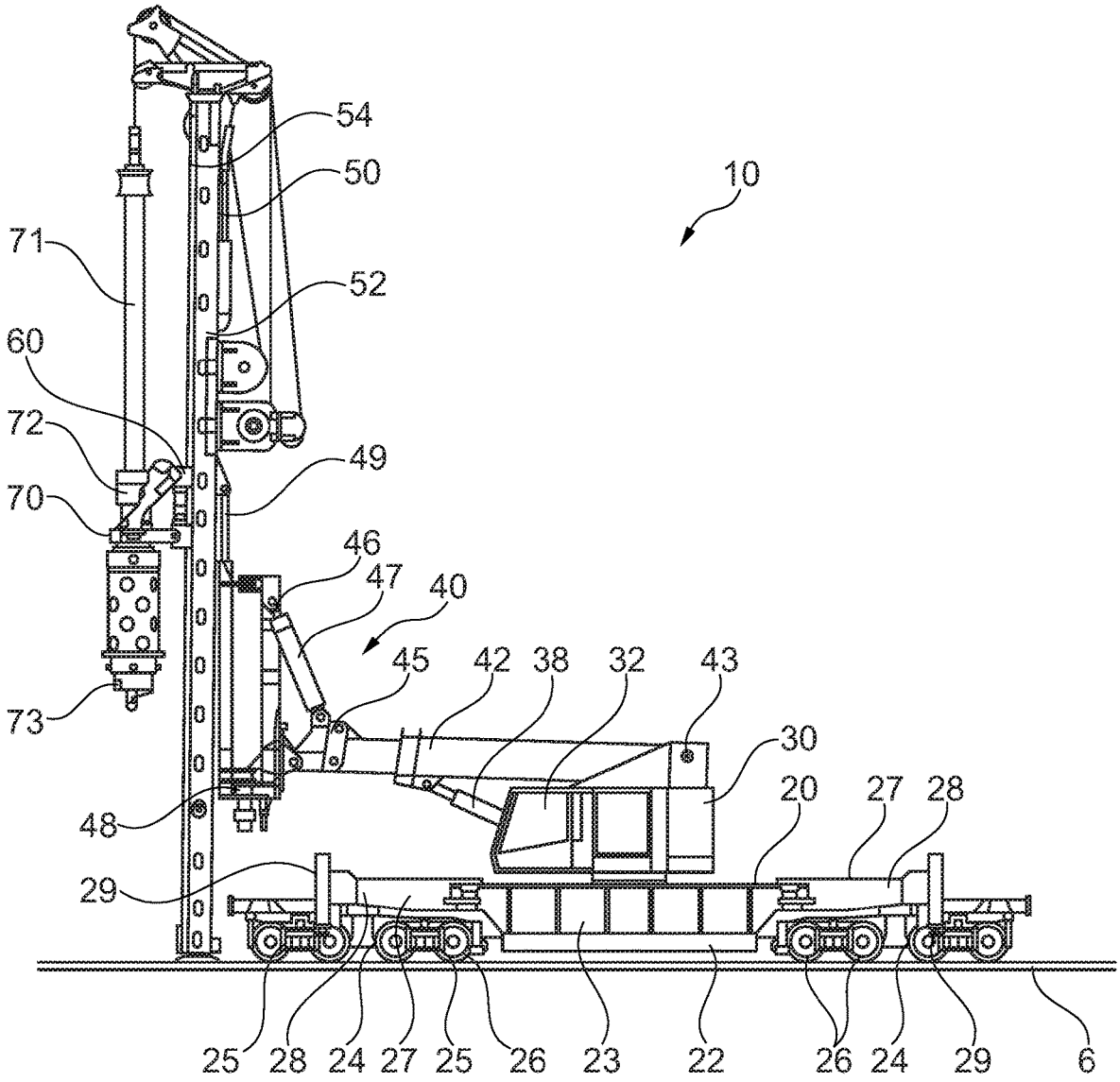
FIG. 1 a side view of a first civil engineering machine according to the invention.
Figure 2:
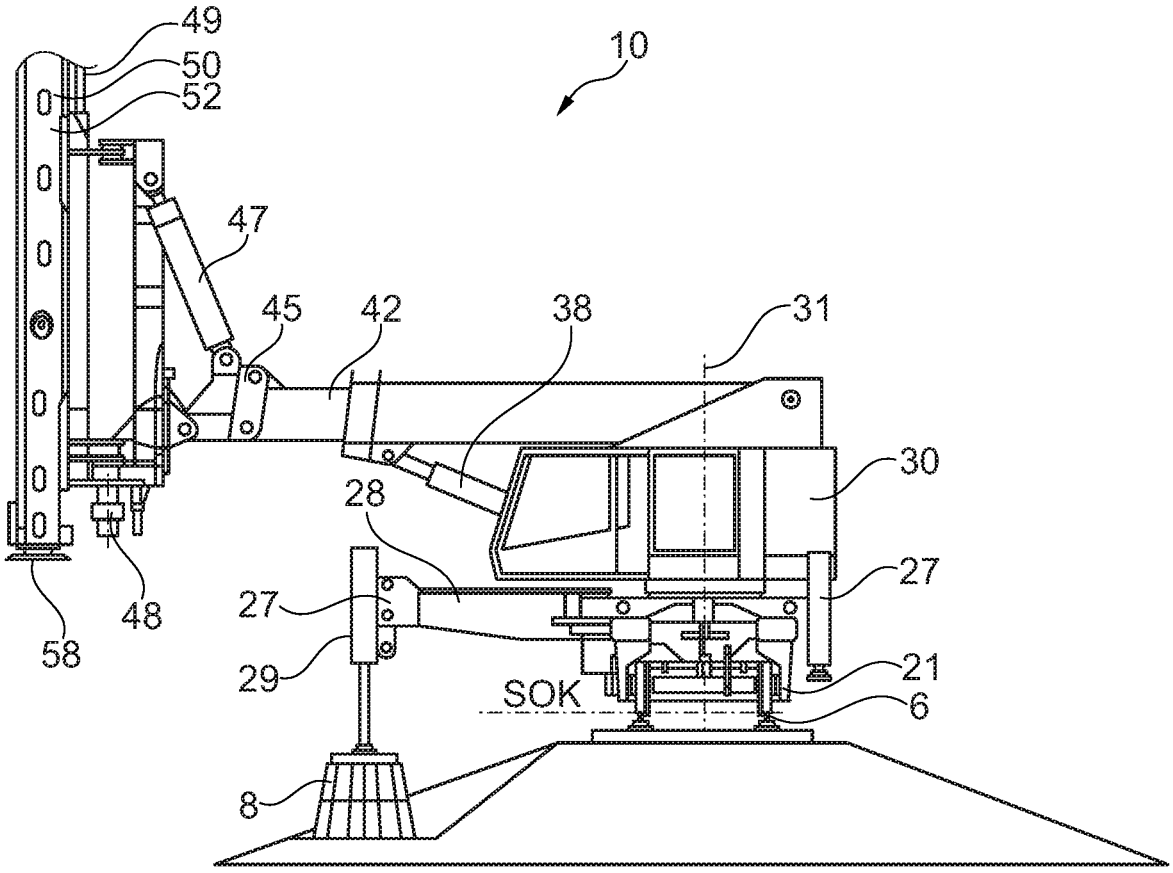
FIG. 2 a view of an enlarged detail of the civil engineering machine of FIG. 1 with pivoted superstructure.

A first civil engineering machine 10 according to the invention is explained in conjunction with FIGS. 1 and 2. For travel on railroad tracks 6, the civil engineering machine 10 includes a track-bounded undercarriage 20 having a flat support frame 22 with a chassis 21, at each end of which is arranged a bogie 24 in each case having four wheel sets 25 with track wheels 26. The undercarriage 20 may have a length of about 12 to 18 meters, preferably about 15 meters. Each wheel set 25 comprises two wheels. The bogie 24 is rotatably mounted about a vertical axis on the support frame 22.

A superstructure 30 with an operator's cab 32 is mounted approximately centrally on the undercarriage 20 so that it can rotate about a vertical axis of rotation 31. A telescopic arm 42, which can be adjusted in length, is mounted on the superstructure 30 so that it can pivot about a horizontal pivot axis 43 and can be pivoted about the horizontal pivot axis 43 by means of at least one actuating cylinder 38. Preferably, two actuating cylinders 38 can be provided. The telescopic arm 42 is part of an articulation mechanism 40, wherein a holding device 46 for holding a leader 50 is arranged at the free end of the telescopic arm 42 via a detachable connecting unit 45. The holding device 46 can be pivoted between the substantially vertical operating position shown in FIGS. 1 and 2 and a substantially horizontal transport position by means of a tilt cylinder 47.

In addition, a pivoting unit 48 is arranged on the holding device 46, by means of which a vertical adjustment unit 49 can be pivoted with the leader 50 about a pivot axis that is vertical in FIG. 1. By means of the vertical adjustment unit 49, the leader 50 can be adjusted in the vertical direction or in the longitudinal direction of the leader 50 via the vertical support 52.

The drive unit for driving the civil engineering machine 10, which is not shown in FIGS. 1 and 2, is substantially arranged in a receiving space 23 on the support frame 22 of the undercarriage 20. The drive unit serves both as a travel drive for the undercarriage 20 for automatic travel, for adjusting the superstructure 30 as well as the articulation mechanism 40, and also for operating a construction work implement 70 on the leader 50.

According to FIGS. 1 and 2, a linear guide 54 is formed on a front side of the vertical support 52 of the leader 50, along which a work-carriage 60 with the construction work implement 70 is mounted so as to be vertically adjustable. In the illustrated exemplary embodiment, the construction work implement 70 is configured for drilling a hole. For this purpose, a drill drive 72 is attached to the work-carriage 60. The drill drive 72 rotationally drives a Kelly bar 71 suspended from the leader 50 via a cable. A drilling tool 73 is detachably attached to the lower end of the Kelly bar 71.

To carry out a construction project along the railroad tracks 6, the construction work implement 70 is pivoted outward with the superstructure 30 about the vertical axis of rotation 31 usually by about 30° to 60°, in individual cases up to a maximum of 90°, as shown schematically in FIG. 2. To ensure the tilt stability of the civil engineering machine 10, lateral support systems 27 with a laterally outward-pivotable pivoting carrier 28 are arranged on the undercarriage 20. Vertically extendable supports 29 are arranged at the free end of each pivot carrier 28. This allows the vertical supports 29 to be supported on the ground or on prepared support elements 8. In addition, an optionally hydraulically extendable support foot 58 can be arranged at the lower end of the vertical support 52 of the leader 50, by means of which the leader can be supported directly on the ground.

Figure 3:
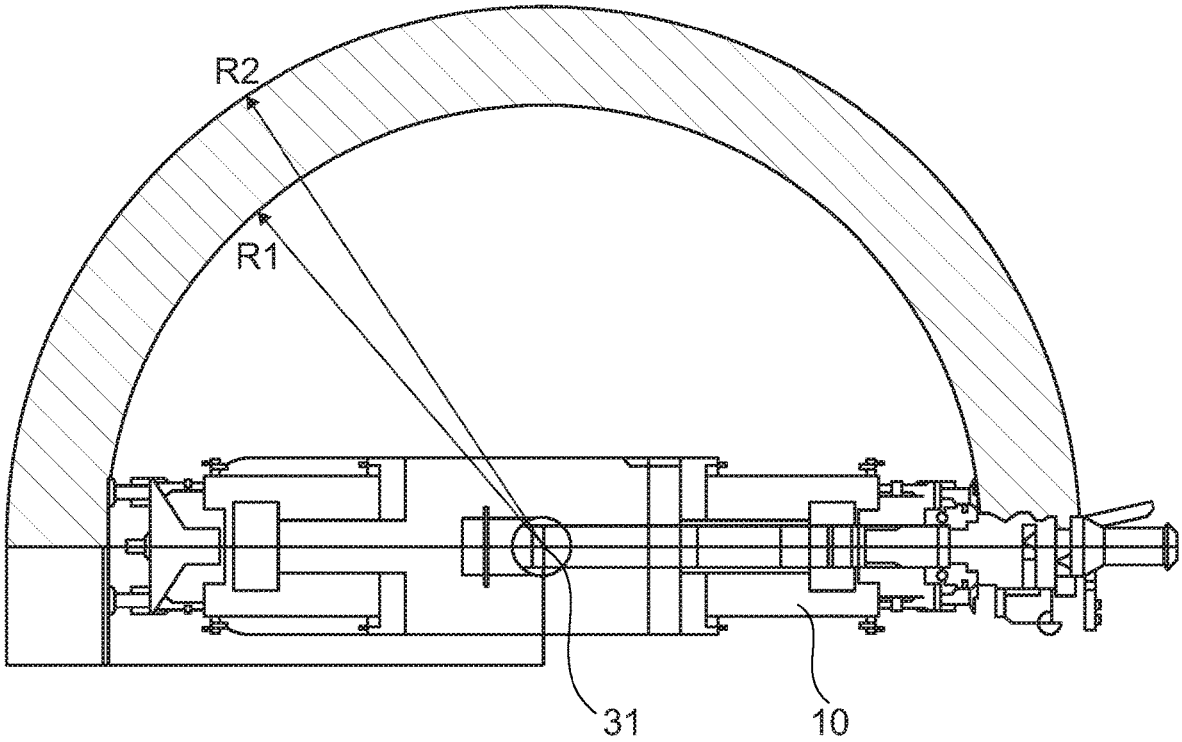
FIG. 3 a schematic top view of a civil engineering machine according to the invention.

FIG. 3 schematically shows a possible working range or adjustment range of the civil engineering machine 10 according to FIGS. 1 and 2. The non-hatched area within the inner radius R1 denotes a working area in which the leader 50 is held solely by the telescopic arm 42 of the articulation mechanism 40. The hatched work area between the inner radius R1 and the outer radius R2 requires the leader 50 to be supported on the ground by the support foot 58.

Depending on the respective travel position of the civil engineering machine 10 along the railroad tracks 6, the rotational position of the superstructure 30 around the vertical axis of rotation 31, the support of the leader 50 with the support foot 58 and the extended position of the telescopic arm 42, a working area with a distance corresponding to the maximum outer radius R2 can thus be reliably worked along tracks.

Figure 4:
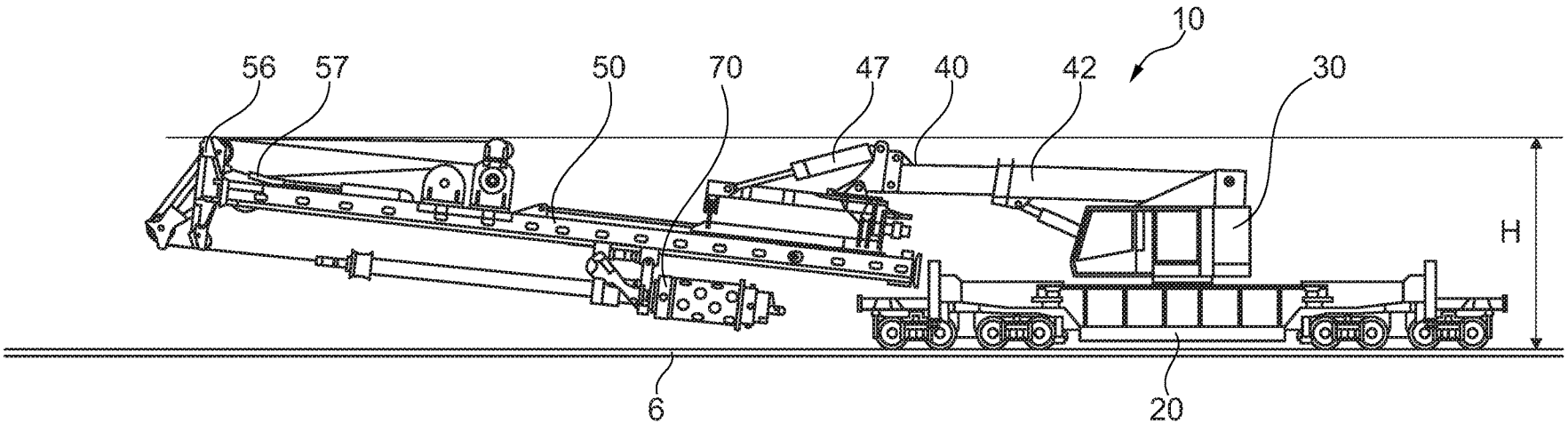
FIG. 4 a side view of the civil engineering machine according to the invention according to FIG. 1 in a transport position.

FIG. 4 shows a first transport position of the civil engineering machine 10 according to FIGS. 1 and 2. For the transport position, the superstructure 30 is oriented longitudinally to the undercarriage 20. The telescopic arm 42 of the articulation mechanism 40 is extended axially. At the same time, the tilt cylinder 47 is extended so that the leader 50 is arranged approximately horizontally with a certain angle of inclination with respect to the horizontal. In this transport position, the leader 50 is thus essentially positioned in a lying position in front of the actual undercarriage 20. If necessary, a mast head 56 on the leader 50 can be folded in by means of a folding cylinder 57, so as to further reduce the overall height H of the track-bounded civil engineering machine 10 in the transport position, so as to provide a maximum permissible height for rail transport. Preferably, this is possible when the operation of the construction work implement 70 does not require rope guidance via the pulleys located at the mast head. In this state, shorter distances in particular can be covered in slow travel, e.g. within a construction site, so that the first transport position is also referred to as the offset position.

Figure 5:
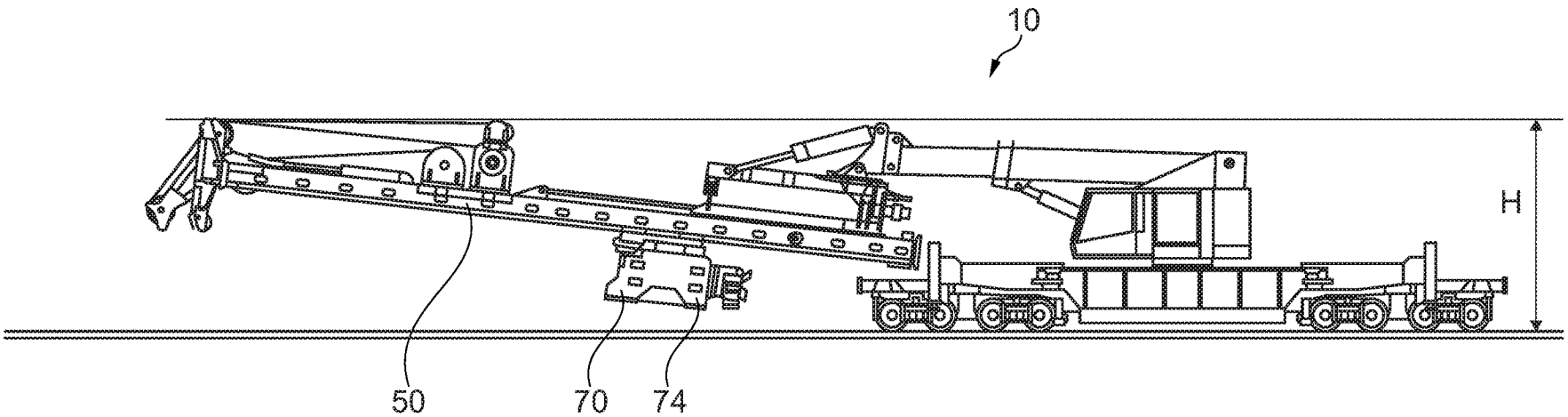
FIG. 5 a side view of another civil engineering machine according to the invention with a vibrator in a transport position according to FIG. 4.

FIG. 5 shows a further civil engineering machine 10 according to the invention in the transport position according to FIG. 4, which largely corresponds to the machine described above, but where a vibrator 74 is adjustably mounted on the leader 50 as a construction work implement 70. The vibrator 74 has, in particular, rotationally drivable unbalanced masses with which targeted vibrations can be generated, for example for driving sheet piles into a ground.

Figure 6:
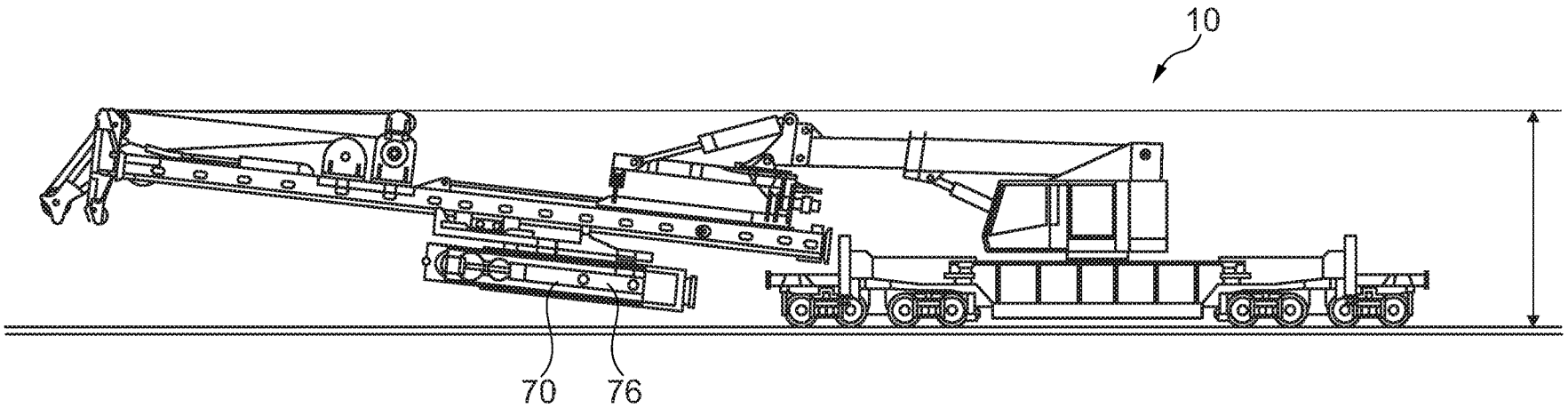
FIG. 6 a side view of another civil engineering machine according to the invention with a pile driver in a transport position corresponding to FIGS. 4 and 5.

FIG. 6 shows another civil engineering machine 10 according to the invention in the transport position according to FIGS. 4 and 5, wherein the construction work implement 70 comprises a pile driver 76. The pile driver 76 can be used to apply targeted impact pulses for driving beams or piles into the ground.

Figure 7:
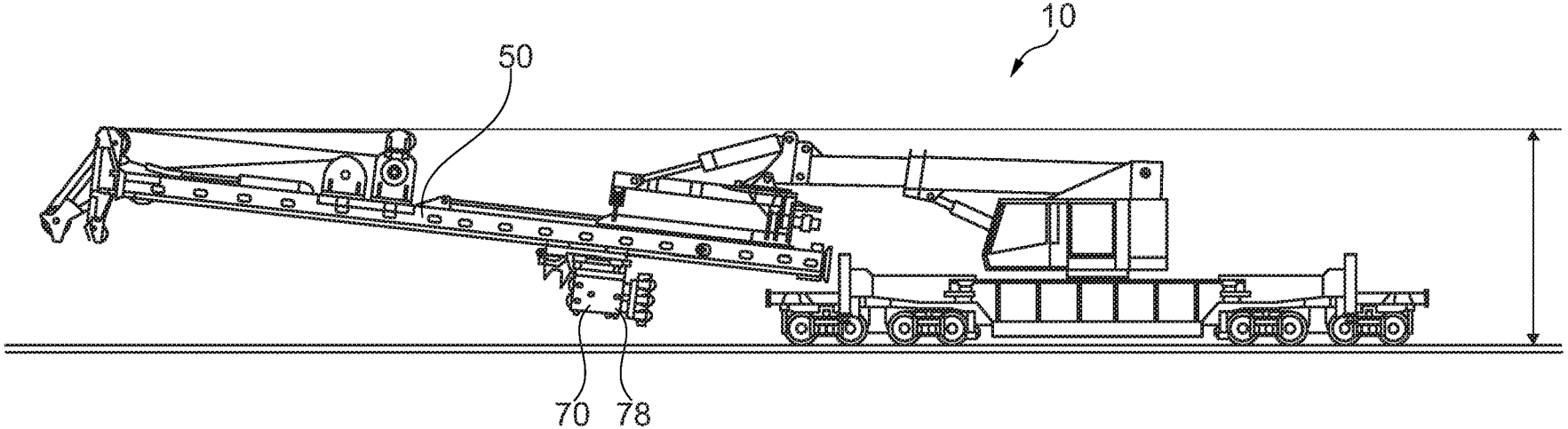
FIG. 7 a side view of another civil engineering machine according to the invention with a sheet pile press in a transport position corresponding to FIGS. 4 to 6.

Referring to FIG. 7, another civil engineering machine 10 according to the invention is shown in the transport position corresponding to FIGS. 4 to 6, wherein a sheet pile press 78 for pressing sheet piles into the ground is attached to the leader 50 as the construction work implement 70.

Figure 8:
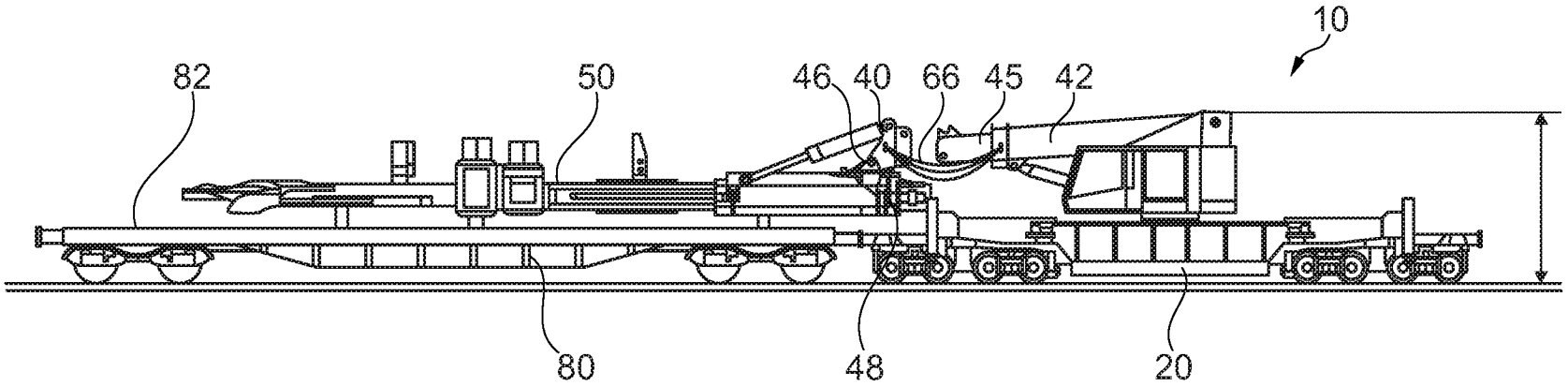
FIG. 8 another embodiment of a civil engineering machine according to the invention in a transport state with an auxiliary car.
Figure 9:
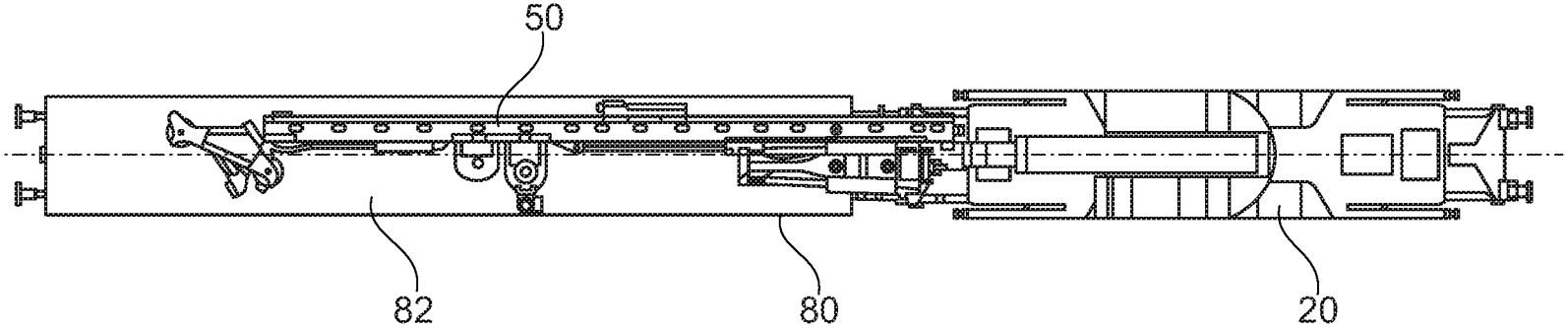
FIG. 9 a top view of the civil engineering machine according to FIG. 8.

FIGS. 8 and 9 show a civil engineering machine 10 according to the invention in another transport position, which is particularly suitable for covering longer distances and at higher travel speeds. For this purpose, the civil engineering machine 10 having the track-bounded undercarriage 20 comprises an auxiliary car 80, which can be detachably coupled to the undercarriage 20. In this case, the civil engineering machine 10 and the auxiliary car 80 can be incorporated into a train formation with an external drive unit such as a locomotive, for example, or can be driven only by an external drive device such as a locomotive. An upper side of the auxiliary car 80 is formed as a support 82 for the leader 50.

For placing, the leader 50 is preferably brought into a substantially horizontal position by the articulation mechanism 40 on the superstructure 30 after the leader has been pivoted by 90° along an axis parallel to the longitudinal direction of the leader by the pivoting means 48, and is placed immediately or preferably after being pivoted by 90° to the side onto the support 82 of the auxiliary car 80. The 90° pivoting is preferably performed with the mast being in vertical position. The connecting unit 45 between the telescopic arm 42 and the holding device 46 of the articulation mechanism 40 can then be detached. Now the telescopic arm 42 can be retracted again. Optionally or in addition, the placed leader 50 can be shifted laterally and/or in the track direction on the auxiliary car 80 in order to bring the center of gravity of the unit of leader 50 and work carriage 60 as close as possible to the center of the auxiliary car 80. The mast head 56 can be folded to prevent it from projecting laterally beyond the width of the auxiliary car 80. Thereby line connections 66 may remain between the telescoping arm 42 on the superstructure 30 and the leader 50 placed on the auxiliary car 80. The line connections may be power lines and/or data lines. This enables the leader 50 to be reconnected to the superstructure almost automatically by extending the telescopic arm 42 and closing the connecting unit 45 when another construction site is reached, without having to re-establish the line connections 66 before starting work.

The civil engineering machines 10 shown in FIGS. 1 to 9 basically have the same structure, although said structure differs significantly in the type of construction work implement 70 used.

The invention claimed is:

1. A civil engineering machine, comprising an undercarriage which comprises a chassis, a superstructure with an operator's cab, the superstructure being mounted on the undercarriage, so as to be rotatable about a vertical axis of rotation, a leader with a linear guide along which a work carriage with a construction work implement is displaceably mounted, and an articulation mechanism by means of which the leader is adjustably mounted on the superstructure, wherein the articulation mechanism comprises a telescopic arm having a horizontal pivot axis on one end and a free end on the other end, the horizontal pivot axis being located above the operator's cab, and a holding device arranged at the free end of the telescopic arm so as to be pivotable around the telescopic arm and configured to hold the leader such that the leader is pivotable between a vertical position and a horizontal position, the leader being held only by the holding device, a distance of the leader relative to the superstructure is adjustable by extending or retracting telescoping of the telescopic arm when the telescopic arm is substantially horizontally oriented, without substantial changes to the vertical position of the leader, the undercarriage is configured as a track-bounded undercarriage with a chassis having wheels for driving on railroad tracks, and in a transport position for traveling on the railroad tracks, the telescopic arm is oriented substantially horizontally above the operator's cab and is extended axially and the holding device places the leader in a lying position in front of the undercarriage.

2. The civil engineering machine according to claim 1, wherein the leader is mounted on the holding device, so as to be displaceable parallel to its linear guide.

3. The civil engineering machine according to claim 2, wherein the holding device comprises a pivoting unit by means of which the leader is pivotable about a pivot axis of the leader which is oriented in parallel to the linear guide of the leader.

4. The civil engineering machine according to claim 2, wherein a detachable connecting unit is arranged on the holding device, by means of which the leader is connectible to the telescopic arm in an easily detachable manner.

5. The civil engineering machine according to claim 4, wherein the detachable connecting unit is actuatable automatically.

6. The civil engineering machine according to claim 4, wherein the holding device is mounted on the connecting unit such that the holding device is pivotable relative to the telescopic arm.

7. The civil engineering machine according to claim 1, wherein the leader is pivotable from a substantially vertical operating position into a substantially horizontal rest position, which, in the longitudinal direction, is located in front of the superstructure.

8. The civil engineering machine according to claim 7, wherein the leader is placed on a support in the rest position, a detachable connecting unit is arranged on the holding device, by means of which the leader is connectible to the telescopic arm in a detachable manner, and the leader is detachable from the telescopic arm in the placed rest position on the support by detaching the connecting unit.

9. The civil engineering machine according to claim 8, wherein the support is configured for placing the leader on a transport car.

10. The civil engineering machine according to claim 1, wherein the telescopic arm is actuatable hydraulically.

11. The civil engineering machine according to claim 1, wherein the construction work implement comprises a vibrator, a drill drive, a pile driver, a sheet pile press or a cutter on the work carriage.

* * * * *